US008162036B2

(12) United States Patent
Hsiao et al.

(10) Patent No.: US 8,162,036 B2
(45) Date of Patent: Apr. 24, 2012

(54) HEAT PIPE STRUCTURE AND FLATTENED HEAT PIPE STRUCTURE

(75) Inventors: Wei-Chung Hsiao, Taipei (TW); Hsuan-Cheng Wang, Taipei (TW); Chi-Wei Tien, Taipei (TW)

(73) Assignee: Compal Electronics, Inc., Taipei (TW)

( * ) Notice: Subject to any disclaimer, the term of this patent is extended or adjusted under 35 U.S.C. 154(b) by 444 days.

(21) Appl. No.: 12/116,216

(22) Filed: May 7, 2008

(65) Prior Publication Data

US 2009/0173475 A1 Jul. 9, 2009

(30) Foreign Application Priority Data

Jan. 7, 2008 (TW) ..... 97100549 A

(51) Int. Cl.
*F28D 15/02* (2006.01)

(52) U.S. Cl. ..... 165/104.21; 165/104.33

(58) Field of Classification Search ..... 165/104.26, 165/104.33, 133, 184
See application file for complete search history.

(56) References Cited

U.S. PATENT DOCUMENTS 3,901,311 A * 8/1975 Kosson et al. ..... 165/104.26
4,116,266 A * 9/1978 Sawata et al. ..... 165/104.26
4,489,777 A * 12/1984 Del Bagno et al. ..... 165/104.26
4,602,679 A * 7/1986 Edelstein et al. ..... 165/104.26
4,658,892 A * 4/1987 Shinohara et al. ..... 165/133
5,259,448 A * 11/1993 Masukawa et al. ..... 165/133
5,465,782 A * 11/1995 Sun et al. ..... 165/104.26
5,692,560 A * 12/1997 Messant et al. ..... 165/151
5,704,424 A * 1/1998 Kohno et al. ..... 165/184
6,863,118 B1 * 3/2005 Wang et al. ..... 165/104.26
6,883,597 B2 * 4/2005 Thors et al. ..... 165/133

FOREIGN PATENT DOCUMENTS

CN 1592567 3/2005
TW M270642 7/2005
WO 9429625 12/1994

OTHER PUBLICATIONS

"1st Office Action of China counterpart application", issued on Dec. 4, 2008, p. 1-p. 7.
"Office Action of China Counterpart Application", issued on Apr. 25, 2011, p. 1-p. 10, in which the listed reference was cited.

* cited by examiner

*Primary Examiner* — Teresa Walberg
(74) *Attorney, Agent, or Firm* — Jianq Chyun IP Office

(57) ABSTRACT

A heat pipe structure including a pipe body and a working substance is provided. The pipe body has two closed ends opposite to each other, an inner surface, a compressed portion, and an expanded portion. The inner surface and the two closed ends form a cavity. The compressed portion includes a plurality of first grooves formed at the inner surface. Any one of the first grooves includes a first width. The expanded portion includes a plurality of second grooves formed at the inner surface. Any one of the second grooves includes a second width, and the first width is approximately equal to the second width. The working substance is contained in the cavity.

18 Claims, 3 Drawing Sheets

HEAT PIPE STRUCTURE AND FLATTENED HEAT PIPE STRUCTURE

CROSS-REFERENCE TO RELATED APPLICATION

This application claims the priority benefit of Taiwan application serial no. 97100549, filed on Jan. 7, 2008. The entirety of the above-mentioned patent application is hereby incorporated by reference herein and made a part of specification.

BACKGROUND OF THE INVENTION

1. Field of the Invention

The present invention relates to a heat transfer structure and, more particularly, to a heat pipe structure applied in an electronic apparatus.

2. Description of Related Art

Due to the development of electronic circuits toward higher integration level and small size, various kinds of electronic apparatus are being made lighter, thinner and smaller. However, a problem arising from the miniaturization of the electronic apparatus is that heat generated by electronic elements of the electronic apparatus is becoming more and more concentrated and it is increasingly difficult to dissipate to ambient environment. This can easily result in overheating of the electronic elements, which incapacitates the electronic elements, making them unable to function normally. Hence, heat dissipation plays a major role to solving the problem and heat dissipating technology becomes extremely important. Since a heat pipe is often used as a heat transfer element in the heat dissipating technology, to design the heat pipe structure to enhance the heat transfer efficiency is what is needed.

SUMMARY OF THE INVENTION

The present invention is directed to a heat pipe structure that has high heat transfer efficiency.

The present invention is also directed to a heat pipe structure that has high heat transfer efficiency after being flattened.

The present invention provides a heat pipe structure that includes a pipe body and a working substance. The pipe body includes two closed ends opposite to each other, an inner surface, a compressed portion and an expanded portion. The inner surface and the two closed ends collectively form a cavity. The compressed portion includes a plurality of first grooves formed at the inner surface. Any one of the first grooves has a first width. The expanded portion includes a plurality of second grooves formed at the inner surface. Any one of the second grooves has a second width. The first width is approximately equal to the second width. The working substance is contained in the cavity.

According to one embodiment of the present invention, the pipe body further includes an outer surface with a process identification mark formed thereon.

According to one embodiment of the present invention, the process identification mark is located on the compressed portion.

According to one embodiment of the present invention, the process identification mark is located on the expanded portion.

According to one embodiment of the present invention, the pipe body has an oval cross-section.

According to one embodiment of the present invention, the compressed portion is a bent portion.

According to one embodiment of the present invention, the expanded portion is connected with the compressed portion.

The present invention also provides a heat pipe structure that includes a pipe body and a working substance. The pipe body includes two closed ends opposite to each other, an inner surface, a predetermined compression portion, and a predetermined expansion portion. The inner surface and the two closed ends collectively form a cavity. The predetermined compression portion includes a plurality of first grooves formed at the inner surface. Any one of the first grooves has a first width. The predetermined expansion portion includes a plurality of second grooves formed at the inner surface. Any one of the second grooves has a second width. The first width is larger than the second width. The working substance is contained in the cavity.

According to one embodiment of the present invention, a process identification mark is located on the predetermined compression portion.

According to one embodiment of the present invention, a process identification mark is located on the predetermined expansion portion.

According to one embodiment of the present invention, the pipe body is a round pipe body.

According to one embodiment of the present invention, the predetermined compression portion is a predetermined bending portion.

According to one embodiment of the present invention, the predetermined expansion portion is connected with the predetermined compression portion.

According to one embodiment of the present invention, the heat pipe structure is formed by metal powder sintering.

According to one embodiment of the present invention, the heat pipe structure is formed by cutting a round metal pipe.

According to one embodiment of the present invention, the heat pipe structure is configured to be employed in an electronic apparatus.

The present invention further provides a heat pipe structure including a pipe body and a working substance. The pipe body includes two closed ends, an inner surface, a plurality of first grooves, and a plurality of second grooves. The two closed ends are opposite to each other. The inner surface and the two closed ends collectively form a cavity. The first grooves are formed at the inner surface. Any one of the first grooves has a first width. The second grooves are formed at the inner surface. Any one of the second grooves has a second width unequal to the first width. The working substance is contained in the cavity.

Before the heat pipe structure with the predetermined compression portion and the predetermined expansion portion is flattened, the first width of any one of the first grooves of the predetermined compression portion is larger than the second width of any one of the second grooves of the predetermined expansion portion. As a result, after the heat pipe structure is flattened to form the heat pipe structure with the compressed portion and the expanded portion, the first width of any one of the first grooves of the compressed portion becomes approximately equal to the second width of any one of the second grooves of the expanded portion. As such, after the heat pipe structure is flattened, the first width of the first grooves of the compressed portion will not be too small, and, therefore, the flow speed of the liquid working substance will not be caused to be too slow. Thus, the heat pipe structure of the present invention has high heat transfer efficiency.

In order to make the aforementioned and other features and advantages of the present invention more comprehensible, embodiments accompanied with figures are described in detail below.

DESCRIPTION OF THE EMBODIMENTS

Figure 1A:
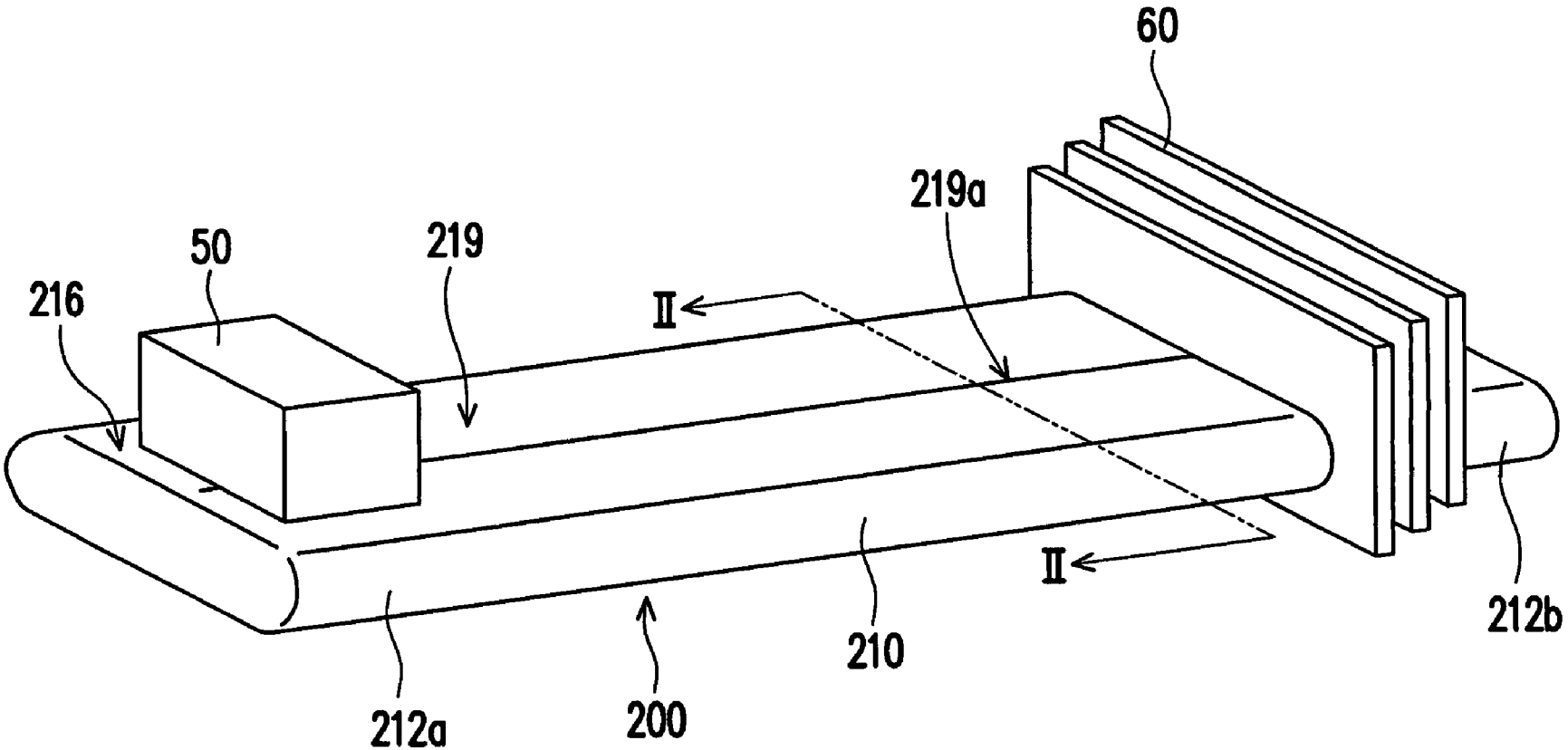
FIG. 1A is a schematic view illustrating a heat pipe structure according to one embodiment of the present invention which transfers heat from a heat generating element to a heat sink.
Figure 1B:
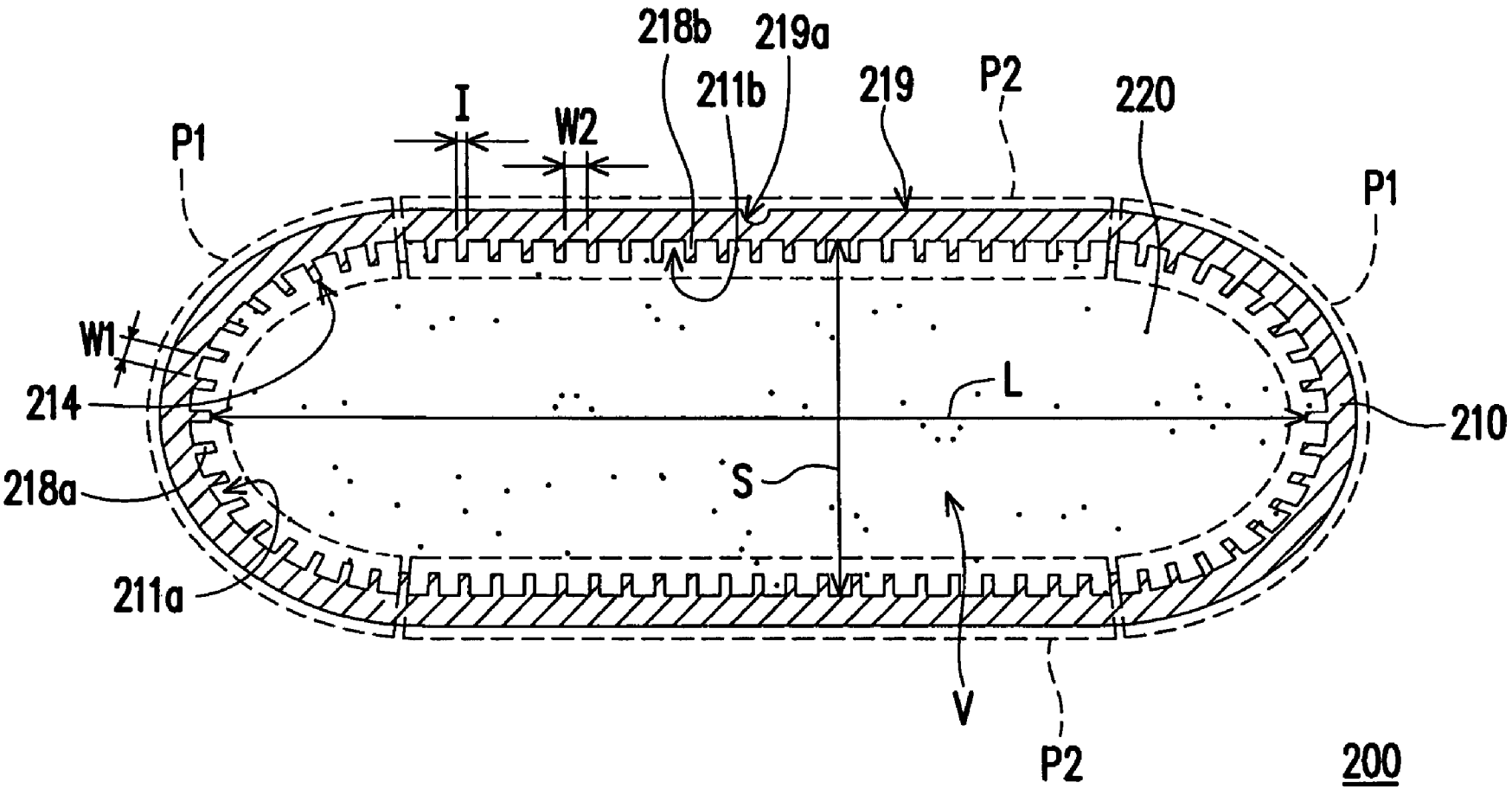
FIG. 1B is a cross sectional view of the heat pipe structure of FIG. 1A, taken along line II-II thereof.

The present invention relates to a heat pipe structure applied in an electronic apparatus. FIG. 1A is a schematic view illustrating a heat pipe structure according to one embodiment of the present invention wherein the heat pipe structure transfers heat from a heat generating element to a heat sink. FIG. 1B is a cross sectional view of the heat pipe structure of FIG. 1A, taken along line II-II thereof. Referring to FIGS. 1A and 1B, the heat pipe structure 200 of this embodiment includes a pipe body 210 and a working substance 220. The pipe body 210 includes two closed ends 212*a*, 212*b* opposite to each other and an inner surface 214. In this embodiment, the pipe body 210 has, for example, an oval cross section. The pipe body 210 may closely contact a heat generating element 50 with its flat outer surface 216. The heat generating element 50 may be an electronic element or any other element that generates heat during operation. The inner surface 214, closed end 212*a* and closed end 212*b* collectively form a cavity V. The working substance 220 is contained in the cavity V and may be water, acetone, ammonia, refrigerant, solid state alcohol or other volatile fluids or solid substances, for example. In this embodiment, the working substance 220 is illustrated as a liquid working substance, but the working substance may be in other states, i.e. the solid state or the gaseous state, in alternative embodiments.

The pipe body 210 further includes two compressed portions P1 opposite to each other and two expanded portions P2 opposite to each other. In this embodiment, the compressed portion P1 is a bent portion, for example, and the degree of curvature of each compressed portion P1 is larger than that of each expanded portion P2. In this embodiment, each compressed portion P1 extends from the closed end 212*a* to the closed end 212*b*, and a first wick structure 218*a* is formed at the inner surface 214 of each compressed portion P1. In addition, each expanded portion P2 extends from the closed end 212*a* to the closed end 212*b*. In this embodiment, one side of each expanded portion P2 is connected with one compressed portion P1, and another side of each expanded portion P2 is connected with the other compressed portion P1. A second wick structure 218*b* is formed on the inner surface 214 of each expanded portion P2. The capillary force per unit area of the first wick structure 218*a* is approximately equal to the capillary force per unit area of the second wick structure 218*b*.

In this embodiment, each first wick structure 218*a* includes a plurality of first grooves 211*a*, i.e., each compressed portion P1 includes a plurality of first grooves 211*a* formed at the inner surface 214 of the compressed portion P1. In addition, each second wick structure 218*b* includes a plurality of second grooves 211*b*, i.e., each expanded portion P2 includes a plurality of second grooves 211*b* formed at the inner surface 214 of the expanded portion P2. In particular, the first grooves 211*a* may extend from the closed end 212*a* to the closed end 212*b*, and the second grooves 212*a* may also extend from the closed end 212*a* to the closed end 212*b*. In this embodiment, each first groove 211*a* has a first width W1, and each second groove 212*b* has a second width W2 approximately equal to the first width W1. As a result, the first wick structure 218*a* and the second wick structure 218*b* can provide approximately the same capillary force per unit area.

The heat generated by the heat generating element 50 in operation is conducted from the closed end 212*a* to the working substance 220, and the working substance 220 is thereby changed from a liquid or solid state to a vapour state. The vapour working substance 220 then carries the heat and moves in the cavity V from the closed end 212*a* to the closed end 212*b* with a relatively lower temperature. At the closed end 212*b*, the vapour working substance 220 condenses into liquid working substance 220 with the heat being released. Thereafter, the heat released from the working substance 220 may be conducted from the closed end 212*b* to a heat sink 60 connected with the closed end 212*b*, and then the heat sink 60 dissipates the heat to ambient air. The heat sink 60 may be a set of cooling fins or other suitable heat dissipating devices, for example. The liquid working substance 220 as a result of the condensation occurring at the closed end 212*b* will be driven back to the closed end 212*a* along the first grooves 211*a* and the second grooves 211*b* by the capillary force generated by such grooves, thus completing one circle of the working substance 220 circulation. Continuous circulation of the working substance 220 will continuously transfer the heat from the heat generating element 50 to the heat sink 60.

In the heat pipe structure 220 of this embodiment, because the first width W1 of the first grooves 211*a* at the inner surface 214 of the pipe body 210 is approximately equal to the second width W2 of the second grooves 211*b* at the inner surface 214 of the pipe body 210, the capillary force per unit area of the first grooves 211*a* of the compressed portion P1 with the larger degree of curvature is approximately equal to the capillary force per unit area of the second grooves 211*b* of the expanded portion P2 with the smaller degree of curvature. As such, the first width W1 of the first grooves 211*a* of the compressed portion P1 will not be too small, so that the velocity of the liquid working substance 220 moving from the closed end 212*b* back to the closed end 212*a* is not slower in the first grooves 211*a* of the compressed portion P1 with the larger degree of curvature. Unlike conventional heat pipe structures in which flow of the working substance is impeded in the grooves at the bent portion of the pipe body, in the heat pipe structure 200 of this embodiment 200, the liquid working substance 220 can flow smoothly in every part of the pipe body 210 (e.g., the compressed portion P1 and expanded portion P 2). As a result, the heat pipe structure of this embodiment has a higher heat transfer efficiency.

In this embodiment, a spacing I between the first grooves 211*a* and a spacing I between the second grooves 211*b* may be substantially the same. Thus, in addition to the convenience in fabricating the first grooves 211*a* and the second grooves 211*b*, the same spacing also allows the liquid working substance 220 to be uniformly distributed over the inner surface 214, thereby making the most of the inner surface 214 with limited area.

Figure 1C:
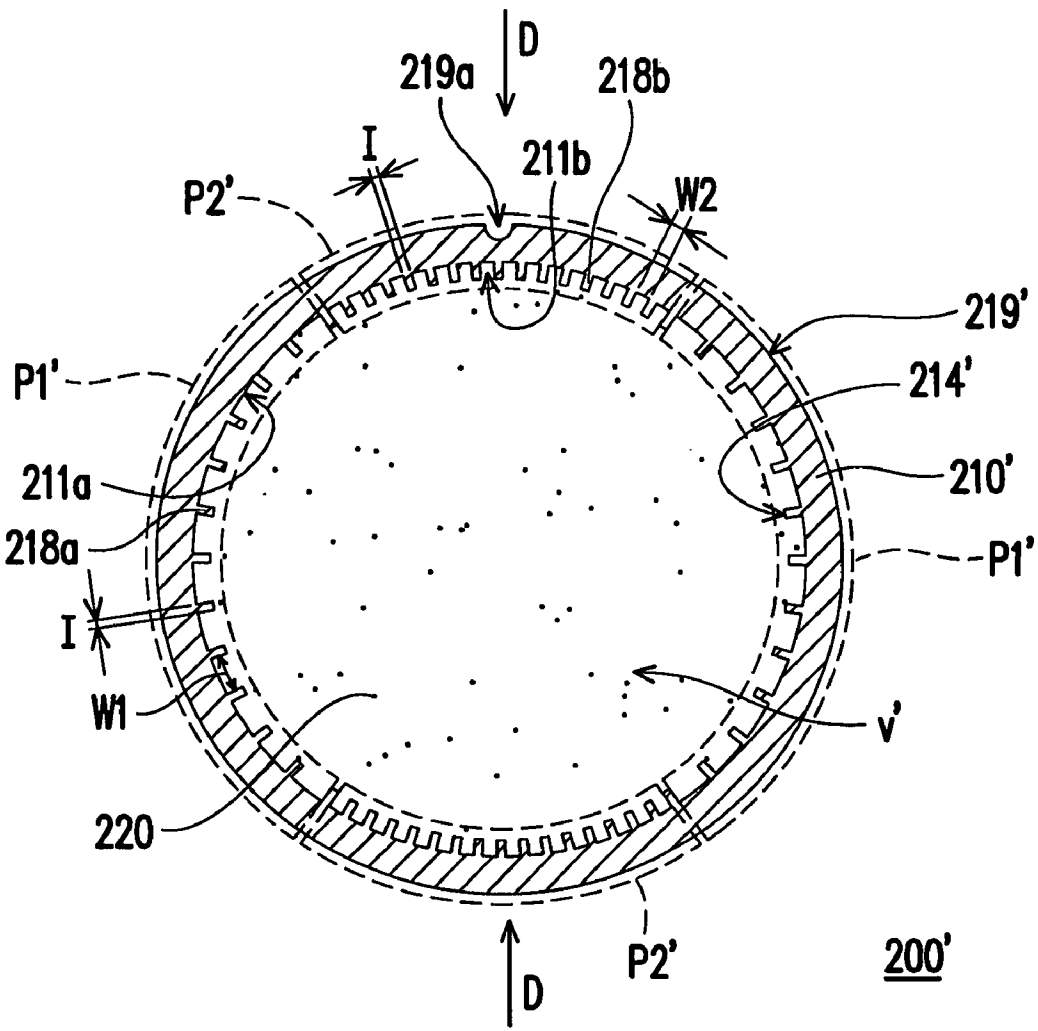
FIG. 1C is a cross sectional view of the heat pipe structure of FIG. 1B prior to being flattened.

FIG. 1C is a cross sectional view of the heat pipe structure of FIG. 1B prior to being flattened. Referring to FIGS. 1A through 1C, the heat pipe structure 200 (as shown in FIG. 1B) may be formed by flattening a heat pipe structure 200' (as shown in FIG. 1C) in a direction D. The heat pipe structure 200' includes a pipe body 210' having a closed end corresponding to the closed end 212*a* of FIG. 1A and the other closed end corresponding to the closed end 212*b* of FIG. 1A.

An inner surface 214' of the pipe body 210' and the two closed ends collectively form a cavity V', and the working substance 220 is contained in the cavity V'. In this embodiment, the pipe body 210' may be a round pipe body, for example, and includes two predetermined compression portions P1' opposite to each other and two predetermined expansion portions P2' opposite to each other. In this embodiment, these predetermined compression portions P1' may be predetermined bending portions. All these predetermined compression portions P1' and these predetermined expansion portions P2' extend from one closed end to the other closed end. In this embodiment, one side of each predetermined expansion portion P2' is connected with one predetermined compression portion P1', and another side of each predetermined expansion portion P2' is connected with the other compressed portion P1'. Upon flattening the pipe body 210', the predetermined compression portions P1' become the compressed portions P1 with larger degree of curvature, and the predetermined expansion portions P2' become the expanded portions P2 with smaller degree of curvature.

A first wick structure 218*a*' is formed at the inner surface 214' of each predetermined compression portion P1', and a second wick structure 218*b*' is formed at the inner surface 214' of each predetermined expansion portion P2'. The capillary force per unit area of the first structure 218*a*' is smaller than the capillary force per unit area of the second wick structure 218*b*'. In this embodiment, each first wick structure 218*a*' includes a plurality of first grooves 211*a*, i.e., each predetermined compression portion P1' includes a plurality of first grooves 211*a*' formed at the inner surface 214' of the predetermined compression portion P1'. Each second wick structure 218*b*' includes a plurality of second grooves 211*b*', i.e., each predetermined expansion portion P2' includes a plurality of second grooves 211*b*' formed at the inner surface 214' of the predetermined expansion portion P2'. In particular, the first grooves 211*a*' may extend from one closed end to the other closed end, and the second grooves 212*b*' may also extend from one closed end to the other closed end. Each first groove 211*a*' has a first width W1' and each second groove 212*b* has a second width W2' unequal to the first width W1'. In general, the first width W1' is larger than the second width W2' such that the capillary force per unit area of the first wick structure 218*a*' is smaller than that of the second wick structure 218*b*'. In this embodiment, the pipe body 210' is formed by cutting a round metal pipe and subsequently forming the first and second wick structures 218*a*', 218*b*' on an inner wall surface of the metal pipe. In an alternative embodiment, a metal powder sintering method may be used to simultaneously form the round metal pipe and the first wick structure 218*a*' and the second wick structure 218*b*' on the inner surface of the round pipe.

When the pipe body 210' is flattened to form the pipe body 210, the predetermined compression portion P1' is bent under force such that the first width W1' of the first grooves 211*a*' is reduced to the first width W1 due to compression (as shown in FIG. 1B). In addition, after the flattening process, the second width W2' of the second grooves 211*b*' is changed to the second width W2. As described above, the first width W1 is approximately the same as the second width W2. In other words, after the flattening process, the capillary force per unit area of the first wick structure 218*a*' and the capillary force per unit area of the second wick structure 218*b*' becomes approximately the same as each other. As such, after the flattening process, the heat pipe structure 200' transforms into the heat pipe structure 200 with high heat transfer efficiency.

In this embodiment, the spacing I between the first grooves 211*a*' and the spacing I between the second grooves 211*b*' may be substantially the same. Thus, in addition to the convenience in fabricating the first grooves 211*a*' and the second grooves 211*b*', the same spacing also allows the liquid working substance 220 to be uniformly distributed over the inner surface 214 after the heat pipe structure 200' is flattened to form the heat pipe structure 200, thereby making the most of the inner surface 214 with limited area.

In order to easily identify the direction D in which the heat pipe structure 200' is flattened during the flattening process, an outer surface 219' of the pipe body 210' may include a process identification mark 219*a* formed on either one of the predetermined compression portion P1' and the predetermined expansion portion P2'. Specifically, the process identification mark 219*a* may be positioned corresponding to a middle one of the first grooves 211*a*' or a middle one of the second grooves 211*b*'. In this embodiment as shown in FIG. 1C, the process identification mark 219*a* is positioned corresponding to the middle one of the second grooves 211*b*'.

As the heat pipe structure 200' is flattened to form the heat pipe structure 200, the process identification mark 219*a* will be located on the outer surface 219 of the pipe body 210, and located on either one of the compressed portions P1 and the expanded portions P2. In particular, the identification mark 219*a* may be positioned corresponding to the long axis or short axis of a cross-section of the pipe body 210. The process identification mark 219 is illustrated in FIG. 1B as corresponding to the short axis.

It should be noted that the wick structure is not intended to be limited to grooves in the present invention. Rather, in other embodiments, the wick structure may be of other types. In addition, the principle of the present invention neither requires the pipe body 210 to have a particular number of the compressed portions P1 and expanded portions P2, nor requires the pipe body 210' to have a particular number of the predetermined compression portions P1' and expanded portions P2'. In one non-illustrated embodiment, prior to being flattened, the pipe body includes one predetermined compression portion and one predetermined expansion portion; after being flattened, the pipe body includes one compressed portion and one expanded portion.

In summary, before the heat pipe structure with the predetermined compression portion and the predetermined expansion portion is flattened, the first width of the first grooves of the predetermined compression portion is larger than the second width of the second grooves of the predetermined expansion portion. Therefore, after the heat pipe structure is flattened to form the heat pipe structure with the compressed portion and the expanded portion, the first width of the first grooves of the compressed portion becomes approximately equal to the second width of the second grooves of the expanded portion. As such, after the pipe body is flattened, the first width of the first grooves of the compressed portion will not be too small, and, therefore, the flow speed of the liquid working substance will not be caused to be too slow. Thus, the heat pipe structure of the present invention has high heat transfer efficiency.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A flattened heat pipe structure, comprising:

a pipe body comprising:

two closed ends opposite to each other;

an inner surface, wherein the inner surface and the two closed ends collectively form a cavity;

an arc-shaped portion comprising a plurality of first grooves at the inner surface, wherein the arc-shaped portion is bent to be arc-shaped, and each of the first grooves has an approximately equal first width;

a flat shaped portion, connected with the arc-shaped portion and comprising a plurality of second grooves at the inner surface, wherein each of the second grooves has a second width approximately equal to the first width; and a working substance contained in the cavity.

2. The flattened heat pipe structure according to claim 1, wherein the pipe body further comprises an outer surface with a process identification mark formed thereon.

3. The flattened heat pipe structure according to claim 2, wherein the process identification mark is located on the compressed portion.

4. The flattened heat pipe structure according to claim 2, wherein the process identification mark is located on the expanded portion.

5. The flattened heat pipe structure according to claim 1, wherein the pipe body has an oval cross section.

6. The flattened heat pipe structure according to claim 1, wherein the compressed portion is a bent portion.

7. The flattened heat pipe structure according to claim 1, wherein the expanded portion is connected with the compressed portion.

8. The flattened heat pipe structure according to claim 1, wherein the heat pipe structure is configured to be employed in an electronic apparatus.

9. A heat pipe structure, comprising:

a pipe body comprising:

two closed ends opposite to each other;

an inner surface, wherein the inner surface and the two closed ends collectively form a cavity;

a predetermined arc-shaped portion comprising a plurality of first grooves at the inner surface, wherein each of the first grooves has a first width;

a predetermined flat shaped portion comprising a plurality of second grooves at the inner surface, wherein each of the second grooves has a second width, and the first width is larger than the second width; and a working substance contained in the cavity, after the pipe body has experienced a compressing process, the predetermined arc-shaped portion is bent to be arc-shaped while the predetermined flat shaped portion is flat shaped, and the first width is then approximately equal to the second width.

10. The heat pipe structure according to claim 9, wherein the pipe body further comprises an outer surface with a process identification mark formed thereon.

11. The heat pipe structure according to claim 10, wherein the process identification mark is located on the predetermined compression portion.

12. The heat pipe structure according to claim 10, wherein the process identification mark is located on the predetermined expansion portion.

13. The heat pipe structure according to claim 9, wherein the pipe body has a circular cross section before compression.

14. The heat pipe structure according to claim 9, wherein the predetermined compression portion is a predetermined bending portion.

15. The heat pipe structure according to claim 9, wherein the predetermined expansion portion is connected with the predetermined compression portion.

16. The heat pipe structure according to claim 9, wherein the heat pipe structure is formed by metal powder sintering.

17. The heat pipe structure according to claim 9, wherein the heat pipe structure is formed by cutting a round metal pipe.

18. The heat pipe structure according to claim 9, wherein the heat pipe structure is configured to be employed in an electronic apparatus.

* * * * *